US006338471B1

(12) United States Patent
Imsdahl et al.

(10) Patent No.: US 6,338,471 B1
(45) Date of Patent: Jan. 15, 2002

(54) FLOW CONTROL SYSTEM FOR AN EVAPORATIVE COOLER SUMP

(75) Inventors: John A. Imsdahl, Bloomington; Michael J. McCarthy, Plymouth, both of MN (US)

(73) Assignee: Donaldson Company, Inc., Minneapolis, MN (US)

( * ) Notice: Subject to any disclaimer, the term of this patent is extended or adjusted under 35 U.S.C. 154(b) by 0 days.

(21) Appl. No.: 09/195,787

(22) Filed: Nov. 18, 1998

(51) Int. Cl.[7] ..... B01F 3/04; B01D 1/00

(52) U.S. Cl. ..... 261/27; 261/34.1; 261/66; 261/67; 261/72.1; 261/DIG. 3; 261/DIG. 43; 62/171

(58) Field of Search ..... 261/26, 27, 34.1, 261/66, 70, 72.1, 152, 153, 97, DIG. 3, DIG. 43, 67; 62/171, 188

(56) References Cited

U.S. PATENT DOCUMENTS

| | | | | |
|---|---|---|---|---|
| 3,741,683 A | | 6/1973 | McTamaney et al. | |
| 3,788,340 A | * | 1/1974 | O'Leary et al. | 261/70 |
| 4,031,180 A | * | 6/1977 | Bohanon | 261/106 |
| 4,098,854 A | | 7/1978 | Knirsch et al. | |
| 5,622,044 A | | 4/1997 | Bronicki et al. | |
| 5,966,953 A | * | 10/1999 | Murr et al. | 62/171 |

FOREIGN PATENT DOCUMENTS

DE 195 41 915 A1 1/1997

OTHER PUBLICATIONS

Gems Sensors brochure for float type sensor, 2 pages (Date Unknown).

"Gems Sensors Liquid Level Switches", http://www.gems-sensors.com/Level_Switches.html, 5 pages (Apr. 22, 1999).

Piping Shematic for Evap Cooler by Donaldson Company, Inc., 1 page (Date Unknown).

* cited by examiner

*Primary Examiner*—David A. Simmons
*Assistant Examiner*—Robert A. Hopkins
(74) *Attorney, Agent, or Firm*—Merchant & Gould P.C.

(57) ABSTRACT

The present disclosure relates to an evaporative cooler for a turbine intake system. The evaporative cooler includes a reservoir for holding water, a media, a manifold for dispersing the water from the reservoir above the media, a manifold flow line extending from the reservoir to the manifold, a collector for collecting the water below the media, and a pump for pumping the water through the manifold flow line from the reservoir to the manifold. The evaporative cooler also includes a return line for returning the water from the collector to the reservoir, at least one water supply line for supplying the water to the reservoir, and a valve structure for controlling flow through the at least one water supply line. The evaporative cooler further includes a level sensor for indicating whether a top surface of the water within the reservoir is: (1) above or below a first water line; and (2) above or below a second water line positioned below the first water line. A controller interfaces with the valve structure and the level sensor. The controller causes the valve structure to: (1) start water flow to the reservoir at a first flow rate when the top surface of the water falls below the first water line; and (2) increase water flow to the reservoir from the first flow rate to a higher second flow rate when the top surface of the water falls below the second water line.

14 Claims, 3 Drawing Sheets

FLOW CONTROL SYSTEM FOR AN EVAPORATIVE COOLER SUMP

FIELD OF THE INVENTION

The present invention relates generally to evaporative coolers for use in gas turbine intake air systems. More particularly, the present invention relates to sumps used with turbine evaporative coolers.

BACKGROUND OF THE INVENTION

A gas turbine engine works more efficiently as the temperature of the intake air drawn into the gas turbine decreases. Turbine efficiency is dependent upon the temperature of the intake air because turbines are constant volume machines. The density of the intake air increases as the temperature of the intake air drops. Consequently, by decreasing the temperature of the intake air, the mass flow rate to the turbine is increased which increases the efficiency of the turbine.

Evaporative cooling is an economical way to reduce the temperature of the intake air drawn into the turbine. An evaporative cooler commonly includes a plurality of vertically stacked volumes of cooler media. A distribution manifold disperses water over the top of the cooler media. The water is drawn from a sump, distributed over the media by the distribution manifold, and then recycled back to the sump. Intake air for the gas turbine flows through the cooler media. As the water falls or flows through the cooler media, the air passing through the media evaporates some of the water. The evaporation process removes some energy from the air, thereby reducing the temperature of the air.

SUMMARY OF THE INVENTION

One aspect of the present invention relates to an evaporative cooler for a turbine air intake system. The evaporative cooler includes a reservoir or sump for holding water, a media, a manifold for dispersing the water from the reservoir above the media, a manifold flow line extending from the reservoir to the manifold, a collector for collecting the water below the media, and a pump for pumping the water through the manifold flow line from the reservoir to the manifold. The evaporative cooler also includes a return line for returning the water from the collector to the reservoir, at least one water supply line for supplying the water to the reservoir, and a valve structure for controlling flow through the at least one water supply line. The cooler further includes a level sensor for indicating whether a top surface of the water within the reservoir is: (1) above or below a first water line; and (2) above or below a second water line positioned below the first water line. A controller of the evaporative cooler interfaces with the valve structure and the level sensor. The controller causes the valve structure to: (1) start water flow to the reservoir at a first flow rate when the top surface of the water falls below the first water line; and (2) increase water flow to the reservoir from the first flow rate to a higher second flow rate when the top surface of the water falls below the second water line.

A variety of advantages of the invention will be set forth in part in the description which follows, and in part will be apparent from the description, or may be learned by practicing the invention. It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several aspects of the invention and together with the description, serve to explain the principles of the invention. A brief description of the drawings is as follows.

DETAILED DESCRIPTION

Reference will now be made in detail to exemplary aspects of the present invention that are illustrated in the accompanying drawings. Wherever possible, the same reference numbers will be used throughout the drawings to refer to the same or like parts.

Figure 1A:
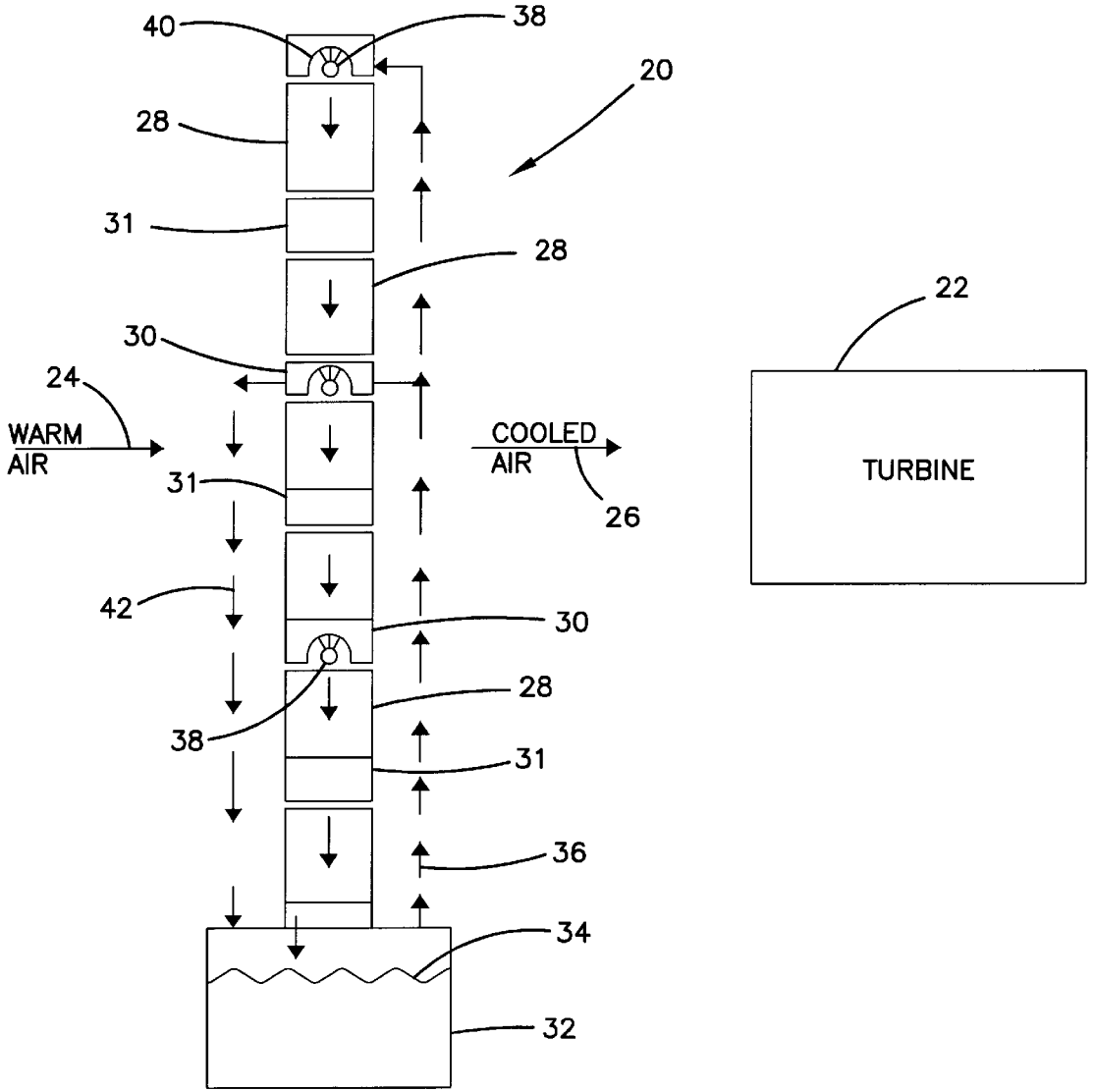
FIG. 1A is a schematic end view of an embodiment of an evaporative cooler for a turbine air intake system.
Figure 1B:
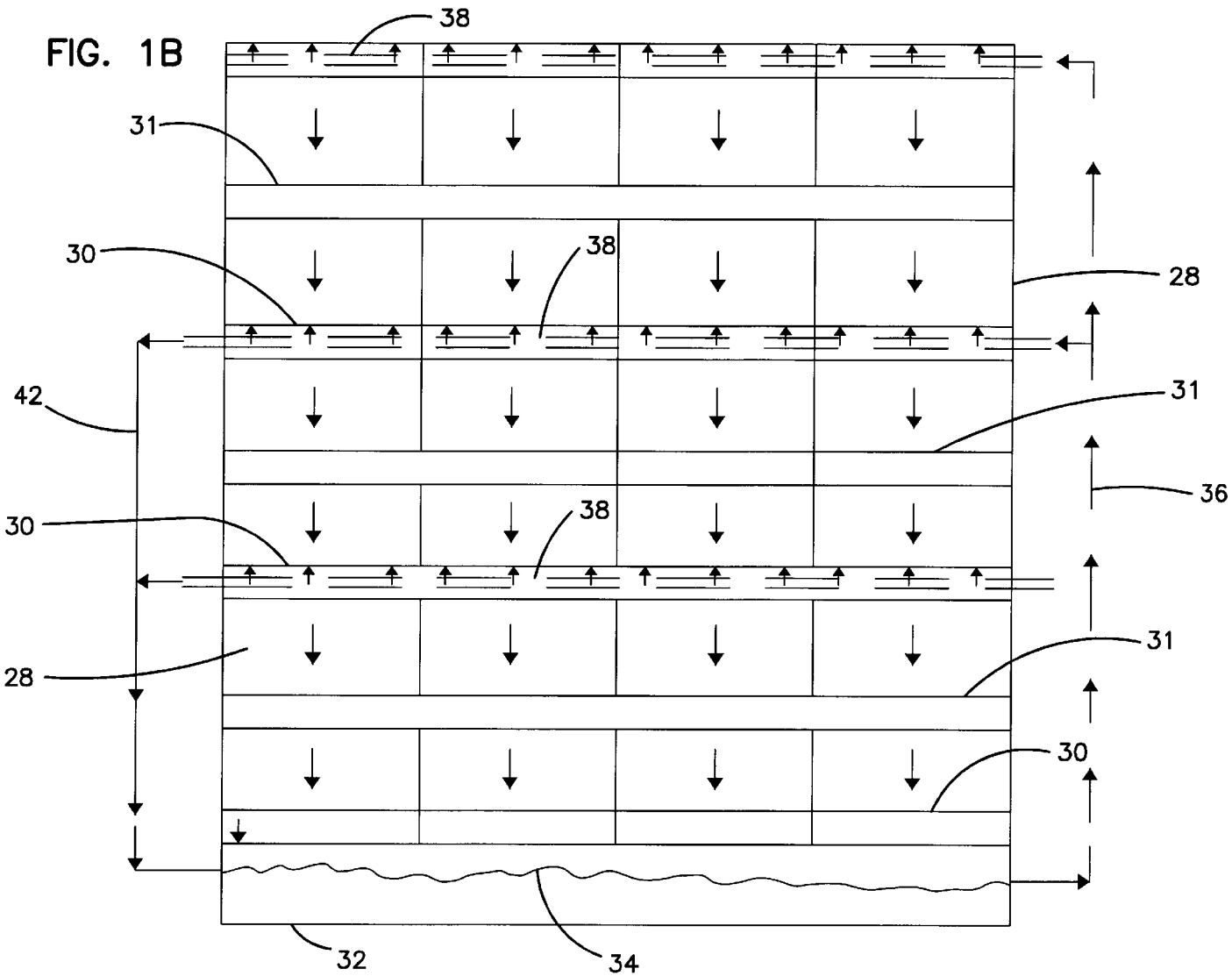
FIG. 1B is a schematic left side view of the evaporative cooler of FIG. 1A.

FIGS. 1A and 1B schematically illustrate an embodiment of an evaporative cooler 20 constructed in accordance with the principles of the present invention. The evaporative cooler 20 is adapted for cooling intake air that is drawn into a gas turbine 22. As shown in FIG. 1A, warm air 24 flows into the left side of the cooler 20, while cooled air 26 exits the right side of the cooler 20. The cooled air 26 flows through a turbine air intake system to the turbine 22.

As shown in FIGS. 1A and 1B, the evaporative cooler 20 includes a plurality of vertically stacked volumes of cooling media 28. The volumes of cooling media 28 are supported on trays 30, 31. The trays 30 are collection trays and function to collect water that drains downward through the volumes of cooling media 28. The trays 31 are flow-through trays that support volumes of cooling media 28, but have openings for allowing water to pass through the trays 31. The trays 30, 31 are preferably connected to a rigid frame work (not shown) that holds the trays 30, 31 and volumes of cooling media 28 in vertically stacked alignment.

The volumes of cooling media 28 can be made of any type of material conventionally used in evaporative coolers. For example, the cooling media can comprise a honeycomb of cellulose based product with resins to enhance rigidity. Suitable cooling media are sold by Munters Corporation of Fort Myers, Fla.

The evaporative cooler 20 also includes a sump or reservoir 32 for holding a volume of water 34. The reservoir 32 preferably has a volume that is at least ten percent the total volume occupied by the volumes of cooling media 28. In use of the evaporative cooler 20, the water 34 from the reservoir 32 is circulated through the volumes of cooling media 28. As the warm air 24 flows through the volumes of cooling media 28, the air evaporates some of the water that is being circulated through the cooling media 28. The evaporation process removes energy from the air, thereby reducing its temperature.

To circulate the water 34 through the volumes of cooling media 28, the water 34 is pumped upward from the reservoir 32 through a manifold flow line 36. The manifold flow line 36 conveys the water 34 to a plurality of manifolds 38. The manifolds 38 include a plurality of upwardly facing spray or orifices for spraying the water 34 in an upward direction. As best shown in FIG. 1A, the water 34 is sprayed from the manifolds 38 in an upward direction against curved dispersion plates 40. After being dispersed by the dispersion plates 40, the water 34 flows downward through the volumes of cooling media 28 via gravity and is collected in the collection trays 30. From the collection trays 30, the water 34 flows downward via gravity through a return line 42 that conveys the water 34 back to the reservoir 32. While a single return line 42 is schematically shown, it will be appreciated that multiple return lines can also be used. For example, a separate return line can be used for each column or bay of the evaporative cooler 20.

Figure 2:
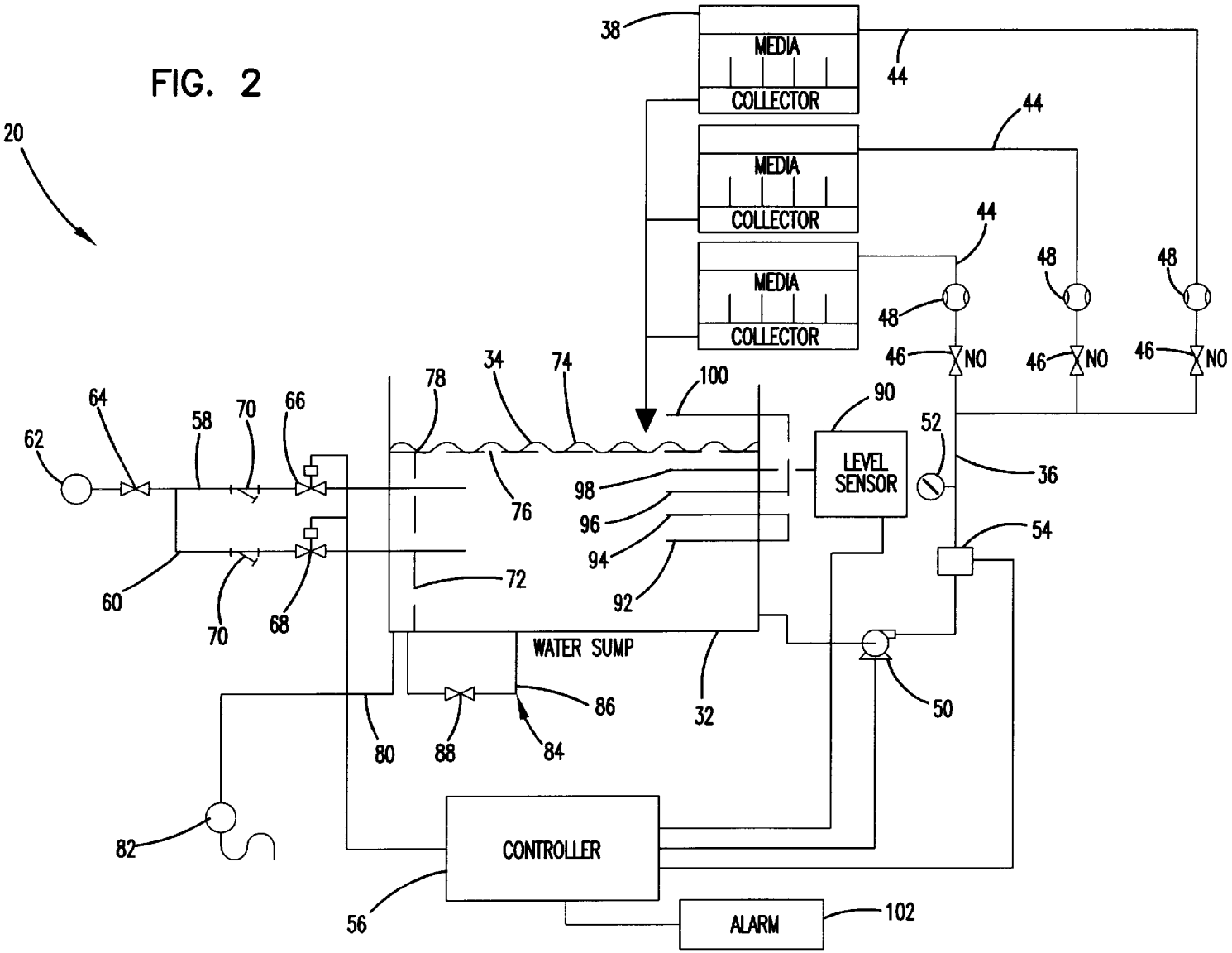
FIG. 2 is a schematic diagram of a flow control system for controlling flow through the evaporative cooler of FIG. 1A.

FIG. 2 illustrates a schematic valving and control diagram for the evaporative cooler 20. As shown in FIG. 2, the manifold flow line 36 is connected to a plurality of branch lines 44 that extend from the manifold flow line 36 to the manifolds 38. Each branch line 44 includes a globe valve 46 and a flow meter 48. By adjusting the globe valves 46 while viewing the flow meters 48, an operator can adjust the water flow rate through each branch line 44.

The manifold flow line 36 also includes a pump such as a centrifugal pump 50 for providing sufficient pressure head to drive the water 34 from the reservoir 32 up through the manifold flow line 36 to each of the manifolds 38. A pressure gauge 52 is positioned upstream from the pump 50. A flow switch 54 is positioned between the pump 50 and the pressure gauge 52. The flow switch 50 measures or monitors the rate of water flow through the manifold flow line 36. If the flow rate through the manifold flow line 36 falls below a preset limit, such as about 10 gallons per minute, the flow switch 54 signals a controller 56 which deactivates the pump 50. In this manner, the flow switch 54 prevents the pump 50 from continuing to pump when insufficient water is being drawn from the reservoir 32. Hence, the flow switch 54 assists in improving the life of the pump 50.

It will be appreciated that the controller 56 can include any type of control unit such as a microcontroller, a mechanical controller, an electrical controller, a hardware driven controller, a firmware driven controller or a software driven controller.

Referring again to FIG. 2, the evaporative cooler 20 also includes first and second water supply lines 58 and 60. The first and second water supply lines 58 and 60 convey water from a source of water 62 to the reservoir 32. A manual gate valve 64 opens and closes flow between the source of water 62 and the first and second water supply lines 58 and 60. Flow through the first water supply line 58 is controlled by a valve structure such as a first solenoid valve 66. Similarly, flow through the second water supply line 60 is controlled by a valve structure such as a second solenoid valve 68. Conventional strainers 70 are positioned upstream from the solenoid valves 66 and 68. The strainers 70 remove contaminants from the water and assist in extending the working lives of the solenoid valves 66 and 68.

The reservoir 32 also includes an overflow weir 72 for draining water from the reservoir 32 when the top surface 74 of the water 34 reaches a predetermined level 76. For example, a spillway 78 is positioned at the predetermined level 76. When the top surface 74 of the water 34 reaches the predetermined level 76, the water spills over the spillway 78 and into a drain line 80. The drain line 80 conveys the overflow water to a water disposal location 82 such as a sewer system.

The reservoir 32 also includes a quick drain 84 for draining the water 34 from the reservoir 32. The quick drain 84 includes a quick drain line 86 having one end in fluid communication with the bottom of the reservoir 32, and another end in fluid communication with the drain line 80. A gate valve 88 is used to open and close the quick drain line 86.

During start up of the evaporative cooler 20, the pump 50 draws water from the reservoir 32 and forces the water through the manifold flow line 36 to the manifold 38. As the pump 50 draws water from the reservoir 32, the water level within the reservoir 32 has a tendency to drop. If the water level falls below a certain level, pump cavitation is possible and the cooling efficiency or effectiveness of the evaporative cooler 20 is compromised. To inhibit the water level within the reservoir 32 from dropping too low at start up conditions, the evaporative cooler 20 uses a multi-level sensor 90 that interfaces with the controller 56. By using input provided by the multi-level sensor 90, the controller 56 can selectively open and close the first and second solenoid valves 66 and 68 to adjust the flow of water into the reservoir 32 from the source of water 62. For example, if the top surface 74 of the water 34 falls below a first level, the controller 56 can open the first solenoid valve 66 such that water is conveyed through the first water supply line 58 into the reservoir 32 at a first flow rate. Additionally, if the top surface 74 of the water 34 falls below a second level located below the first level, the controller 56 can cause the second solenoid valve 68 to open such that water is supplied to the reservoir 32 through both the first and second water supply lines 58 and 60. When both supply lines 58 and 60 are open, water flows into the reservoir at a second flow rate that is faster than the first flow rate.

It will be appreciated that a variety of known level sensors or switches can be used to monitor the depth of the water within the reservoir 32. For example, suitable liquid multi-level switches are sold by Gems Company, Inc., of Farmington, Conn. Such liquid level switches can include multiple floats that trigger switches corresponding to certain liquid levels.

Referring again to FIG. 2, the level sensor 90 monitors multiple water levels that include water level 92, water level 94, water level 96, water level 98, and water level 100. Water level 92 is the lowest water level, while water level 100 is the highest water level. When the top surface 74 of the water 34 falls below water level 92, the level sensor 90 signals the controller 56 which in turn triggers an alarm 102. Similarly, if the top surface 74 of the water 34 rises above water level 100, the level sensor 90 signals the controller 56 which activates the alarm 102. Water level 100 is located above the level 76 of the spillway 78. Consequently, the water level within the reservoir 32 would typically only reach water level 100 in situations in which the drain line 80 has become clogged. In such situations, the alarm 102 gives an operator sufficient time to shut off the water supply gate valve 64 before the water 34 overflows the reservoir 32.

Water level 94 is positioned above water level 92, while water level 96 is positioned above water level 94. When the top surface 74 of the water 34 falls below water level 96, the level sensor 90 signals the controller 56 which causes the first solenoid valve 56 to open such that water flows through the first water supply line 58 into the reservoir 32. If the water level within the reservoir 32 continues to drop and the top surface 74 of the water 34 falls below water level 94, the controller causes the second solenoid valve 68 to open such that water flows into the reservoir 32 through both the first and second water supply lines 58 and 60. The second solenoid valve 68 stays open until the level sensor 90 detects that the water level in the reservoir 32 has risen back to water level 96. When the water level in the reservoir 34 reaches water level 96, the controller 56 causes the second solenoid valve 68 to close the second water supply line 60 such that only the first water supply line 58 continues to supply water to the reservoir 32. The first solenoid valve 66 remains open until the water level in the reservoir 32 reaches water level 98. When the level sensor 90 detects that the water level in the reservoir 32 has reached water level 98, the controller causes the first solenoid valve 66 to close the first water supply line 58.

During start up of the evaporative cooler 20, the pump 50 begins to draw water from the reservoir 32 causing the water level in the reservoir 32 to drop from the spillway level 76 past level 98 to level 96. When the water level reaches water level 96, the controller opens the first solenoid valve 66 such that fresh water is provided to the reservoir 32 through the first water supply line 58. Under certain conditions, the water level within the reservoir 32 may continue to drop and may fall below water level 94. When the water level falls below water level 94, the controller 56 opens the second solenoid valve 68 such that additional water is supplied to the reservoir 32 through the second water supply line 60. The combined flow provided by the first and second water supply lines 58 and 60 causes the water level in the reservoir 32 to begin to rise. Additionally, recirculated water from the return line 42 will also cause the water level in the reservoir 32 to rise. When the water level rises above level 96, the second flow line 60 is closed such that only the first flow line 58 continues to supply water to the reservoir 32. When the water within the reservoir 32 rises above water level 98, the controller 56 causes the first solenoid valve 66 to close the first water supply line 58. At this point in time, the evaporative cooler 20 will operate generally at steady state conditions with the water being circulated from the reservoir 32 up through the manifold flow line 36 to the volumes of cooling media 28, and then back to the reservoir through the return line 42. As the water flows through the volumes of cooling media 28, small amounts of water are evaporated by the warm air 24 passing through the volumes of cooling media 28. Consequently, the water level within the reservoir 32 will gradually drop. When the water level falls below water level 96, the controller again opens the first water supply line 58 such that new water is again supplied to the reservoir 32. The first water supply line 58 remains open until the water level within the reservoir again reaches water level 98.

When the evaporative cooler 20 is shut down, the pump 50 is deactivated and a relatively large volume of water from the volumes of cooling media 28 flows into the reservoir 32 through the return line 42. The water from the volumes of cooling media 28 causes the water level in the reservoir 32 to rise up to the spillway level 78 and overflow into the drain line 80. Consequently, when the evaporative cooler 20 is again started up, the water level within the reservoir 32 will be approximately at the spillway level 76.

In one particular embodiment of the present invention, the sump has a volume of 1900 gallons (gal), new water is supplied to the reservoir at a flow rate of 125 gal/minute (min) when the first flow line is open, new water is supplied to the reservoir at a flow rate of 250 gal/min when both the first and second flow lines are open, and water is withdrawn from the reservoir at a rate of 400 gal/min. In such a non-limiting example, the reservoir has a depth of 22 inches, water level 100 is located 20 inches from the bottom of the reservoir, water level 98 is 4 inches below water level 100, water level 96 is 2 inches below water level 98, water level 94 is 2 inches below water level 96, and water level 92 is 2 inches below water level 94.

With regard to the foregoing description, it is to be understood that changes may be made in detail, especially in matters of the construction materials employed, and the size, shape and arrangement of the parts without departing from the scope of the present invention. For example, the number of media volumes, manifolds and pumps can be varied from those specifically illustrated. It is intended that the specification and the depicted aspects be considered exemplary only, with the true scope and spirit of the invention being indicated by the broad meaning of the following claims.

We claim:

1. An evaporative cooler for a turbine air intake system, the evaporative cooler comprising:

a reservoir for holding water;

a media;

a manifold for dispersing the water from the reservoir above the media;

a manifold flow line extending from the reservoir to the manifold;

a collector for collecting the water below the media;

a pump for pumping the water through the manifold flow line from the reservoir to the manifold;

a return line for returning the water from the collector to the reservoir;

at least one water supply line for supplying the water to the reservoir;

a valve structure for controlling flow through the at least one water supply line;

a level sensor for indicating whether a top surface of the water within the reservoir is: 1) above or below a first water level; and 2) above or below a second water level positioned below the first water level; and an electronic controller that interfaces with the valve structure and the level sensor, wherein the controller causes the valve structure to: 1) start water flow to the reservoir at a first flow rate when the top surface of the water falls below the first water level; and 2) increase water flow to the reservoir from the first flow rate to a higher second flow rate when the top surface of the water falls below the second water level.

2. The evaporative cooler of claim 1, wherein the controller causes the valve structure to decrease water flow to the reservoir from the second flow rate to the first flow rate when the top surface of the water rises above the first water level.

3. The evaporative cooler of claim 2, further comprising a third water level positioned above the first water level, wherein the controller causes the valve structure to stop water flow to the reservoir when the top surface of the water rises above the third water level.

4. The evaporative cooler of claim 3, further comprising a fourth water level positioned above the third water level, wherein the controller causes an alarm signal to be generated when the top surface of the water rises above the fourth water level.

5. The evaporative cooler of claim 4, further comprising an overflow weir for draining water from the reservoir, wherein a spillway of the overflow weir is positioned below the fourth water level.

6. The evaporative cooler of claim 4, further comprising a fifth water level positioned below the second water level, wherein the controller causes an alarm signal to be generated when the top surface of the water falls below the fifth water level.

7. The evaporative cooler of claim 1, wherein the at least one water supply line includes first and second water supply lines.

8. The evaporative cooler of claim 7, wherein the valve structure includes a first valve for controlling flow through the first flow line, and a second valve for controlling flow through the second flow line.

9. The evaporative cooler of claim 8, wherein the first and second valves comprise solenoid valves.

10. The evaporative cooler of claim 8, wherein the controller causes only one of the first and second valves to open flow to the reservoir when the top surface of the water falls below the first water level.

11. The evaporative cooler of claim 8, wherein the controller causes both of the first and second valves to open flow to the reservoir when the top surface of the water falls below the second water level.

12. The evaporative cooler of claim 1, wherein the level sensor comprises a single multi-level sensor.

13. An evaporative cooler for a turbine air intake system, the evaporative cooler comprising:

a reservoir for holding water;

a media;

a manifold for dispersing water from the reservoir above the media;

a manifold flow line extending from the reservoir to the manifold;

a collector for collecting water below the media;

a pump for pumping water through the manifold flow line from the reservoir to the manifold;

a return line for returning water from the collector to the reservoir;

a first water supply line for supplying water to the reservoir;

a second water supply line for supplying water to the reservoir;

a valve structure for controlling flow through the first and second water supply lines, the valve structure including a first solenoid valve for controlling flow through the first water supply line and a second solenoid valve for controlling flow through the second water supply line;

a level sensor for indicating whether a top surface of the water within the reservoir is: 1) above or below a first water level; and 2) above or below a second water level positioned below the first water level; and a controller that interfaces with the valve structure and the level sensor, the controller causing the first solenoid valve to open the first flow line when the top surface of the water falls below the first water level, and the controller causing the second solenoid valve to open the second flow line when the top surface of the water falls below the second water level, wherein when the top surface of the water falls below the second water level, water is supplied to the reservoir through both the first and second flow lines to prevent the reservoir from being emptied.

14. An evaporative cooler for a turbine air intake system, the evaporative cooler comprising:

a reservoir for holding water;

a media;

a manifold for dispersing the water from the reservoir above the media;

a manifold flow line extending from the reservoir to the manifold;

a collector for collecting the water below the media;

a pump for pumping the water through the manifold flow line from the reservoir to the manifold;

a return line for returning the water from the collector to the reservoir;

at least one water supply line for supplying the water to the reservoir;

a valve structure for controlling flow through the at least one water supply line;

a level sensor for indicating whether a top surface of the water within the reservoir is: 1) above or below a first water level; and 2) above or below a second water level positioned below the first water level; and means for causing the valve structure to start water flow to the reservoir at a first flow rate when the top surface of the water falls below the first water level; and means for causing the valve structure to increase water flow to the reservoir from the first flow rate to a higher second flow rate when the top surface of the water falls below the second water level.

* * * * *